US010544927B2

(12) United States Patent
Yen et al.

(10) Patent No.: US 10,544,927 B2
(45) Date of Patent: Jan. 28, 2020

(54) CLAMP LAMP AND DISPLAYING DEVICE THEREWITH

(71) Applicant: QISDA CORPORATION, Taoyuan (TW)

(72) Inventors: Yung-Ming Yen, New Taipei (TW); Yu-Hsuan Wang, Taipei (TW)

(73) Assignee: QISDA CORPORATION, Taoyuan (TW)

( * ) Notice: Subject to any disclaimer, the term of this patent is extended or adjusted under 35 U.S.C. 154(b) by 0 days.

(21) Appl. No.: 15/937,837

(22) Filed: Mar. 27, 2018

(65) Prior Publication Data

US 2018/0363889 A1 Dec. 20, 2018

(30) Foreign Application Priority Data

Jun. 16, 2017 (CN) ..... 2017 1 0458645

(51) Int. Cl.
*F21V 15/04* (2006.01)
*F21V 21/088* (2006.01)
*F21V 19/00* (2006.01)

(52) U.S. Cl.
CPC ..... *F21V 21/088* (2013.01); *F21V 15/04* (2013.01); *F21V 19/009* (2013.01)

(58) Field of Classification Search
CPC ..... F21V 21/088; F21V 15/04; F21V 19/00
See application file for complete search history.

(56) References Cited

U.S. PATENT DOCUMENTS 5,515,246 A * 5/1996 Maglica ..... B62J 6/00 362/191
5,739,750 A * 4/1998 Drake ..... B62J 6/04 188/24.22
8,387,939 B2 * 3/2013 Ford ..... B62J 6/02 224/418
2006/0003119 A1 * 1/2006 Aiba ..... B65D 65/466 428/34.2
2007/0109803 A1 * 5/2007 Chuang ..... B62J 6/02 362/473
2009/0135619 A1 * 5/2009 Hung ..... B62J 6/02 362/474

(Continued)

FOREIGN PATENT DOCUMENTS

CN 202035067 U 11/2011
CN 202580667 U 12/2012
TW M423787 U1 3/2012

*Primary Examiner* — Anabel Ton
(74) *Attorney, Agent, or Firm* — Winston Hsu

(57) ABSTRACT

A clamp lamp includes a light source, a first clamping part, and a second clamping part. The first clamping part has a first holding portion and a lamp connecting portion connected to the first holding portion. The light source is connected to the lamp connecting portion. The second clamping part has a second holding portion and a counterweight disposed on the second holding portion. The first holding portion and the second holding portion are movably connected with each other. The clamp lamp is fixedly disposed on a structural edge by the first holding portion and the second holding portion clamping the structural edge; therein, the counterweight and the light source are located at two opposite sides of the structural edge, which is conducive to the balance of the clamp lamp on the structural edge.

20 Claims, 8 Drawing Sheets

(56) References Cited

U.S. PATENT DOCUMENTS

| | | | | |
|---|---|---|---|---|
| 2011/0075403 | A1* | 3/2011 | Niezrecki | B62J 6/00 362/183 |
| 2012/0075874 | A1* | 3/2012 | Sherwin | B62J 6/00 362/473 |
| 2013/0272004 | A1* | 10/2013 | Tsai | B62J 6/16 362/473 |

* cited by examiner

CLAMP LAMP AND DISPLAYING DEVICE THEREWITH

BACKGROUND OF THE INVENTION

1. Field of the Invention

The invention relates to an illumination device, and especially relates to a clamp lamp capable of clamping a side of a monitor.

2. Description of the Prior Art

Conventional illumination devices are usually immobile and have a relatively large volume, such as drop lights, recessed lights, table lights and so on. For cases in which a user just needs local illumination or intensive illumination to a local area, e.g. illumination only to a screen (e.g. of a monitor of desktop computers, notebook computers and so on), a lamp nearby is used for the required illumination in general. Currently, lamps capable of being fixed on monitors for use are available on the market. For example, when a small USB lamp which includes a flexible tube, a USB connector at one end of the flexible tube, and a light source (e.g. LED) at the other end of the flexible tube is used for illumination, the USB connector is connected to a USB receptacle of a host (e.g. of desktop or notebook computers), and a user can bend the flexible tube such that the light source can be orientated toward a monitor for illuminating the screen of the monitor. At the moment, the whole lamp is supported only by the USB connector. Because the length of the flexible tube is limited, the light source cannot be shifted too far away from the monitor, resulting in that the illumination area by the light source is limited accordingly. For another example, when a lamp with a clip is used, the weight of the whole lamp is supported through the clip. Because the clip is located at an end of the whole lamp, the clip is requested to be capable of offering enough clamping force so that the lamp can be firmly supported. Furthermore, the clip usually uses two opposite surfaces to clamp a frame edge of a monitor. In general, the clamping area by the clip is relatively large, so a portion of the screen of the monitor is probably covered by the clip, resulting in inapplicability of the lamp to monitors with a narrow frame. For another example, when a lamp which is fastened through double-sided tape is used, the weight of the whole lamp is supported through the double-sided tape. Because weight and moment that the double-sided tape can support is limited, the weight and volume of such lamps are relatively small. Accordingly, the light source thereof cannot be shifted too far away from the monitor, and the illumination area by the light source is limited.

SUMMARY OF THE INVENTION

An aspect of the invention is to provide a clamp lamp which uses a counterweight to reduce the torque that a fixing structure of the clamp lamp sustains, which is conducive to the stability of the fixing of the clamp lamp and enhancement of the design flexibility to the disposition of the light source thereof relative to the whole clamp lamp.

A clamp lamp according to the invention includes a light source, a first clamping part, and a second clamping part. The first clamping part has a first holding portion and a lamp connecting portion connected to the first holding portion. The light source is connected to the lamp connecting portion. The second clamping part has a second holding portion and a counterweight disposed on the second holding portion. The first holding portion and the second holding portion are movably connected with each other. Thereby, when the clamp lamp clamp a structural edge (e.g. a side of a outer casing of a monitor of a desktop or notebook computer), the counterweight and the light source can produce opposite moments relative to the structural edge, which is conducive to reduction of the torque that the first holding portion and the second holding portion sustains when clamping the structural edge, so as to enhance the stability of the clamp lamp fixed on the structural edge and the design flexibility to the disposition of the light source thereof relative to the whole clamp lamp.

These and other objectives of the present invention will no doubt become obvious to those of ordinary skill in the art after reading the following detailed description of the preferred embodiment that is illustrated in the various figures and drawings.

DETAILED DESCRIPTION

Figure 1:
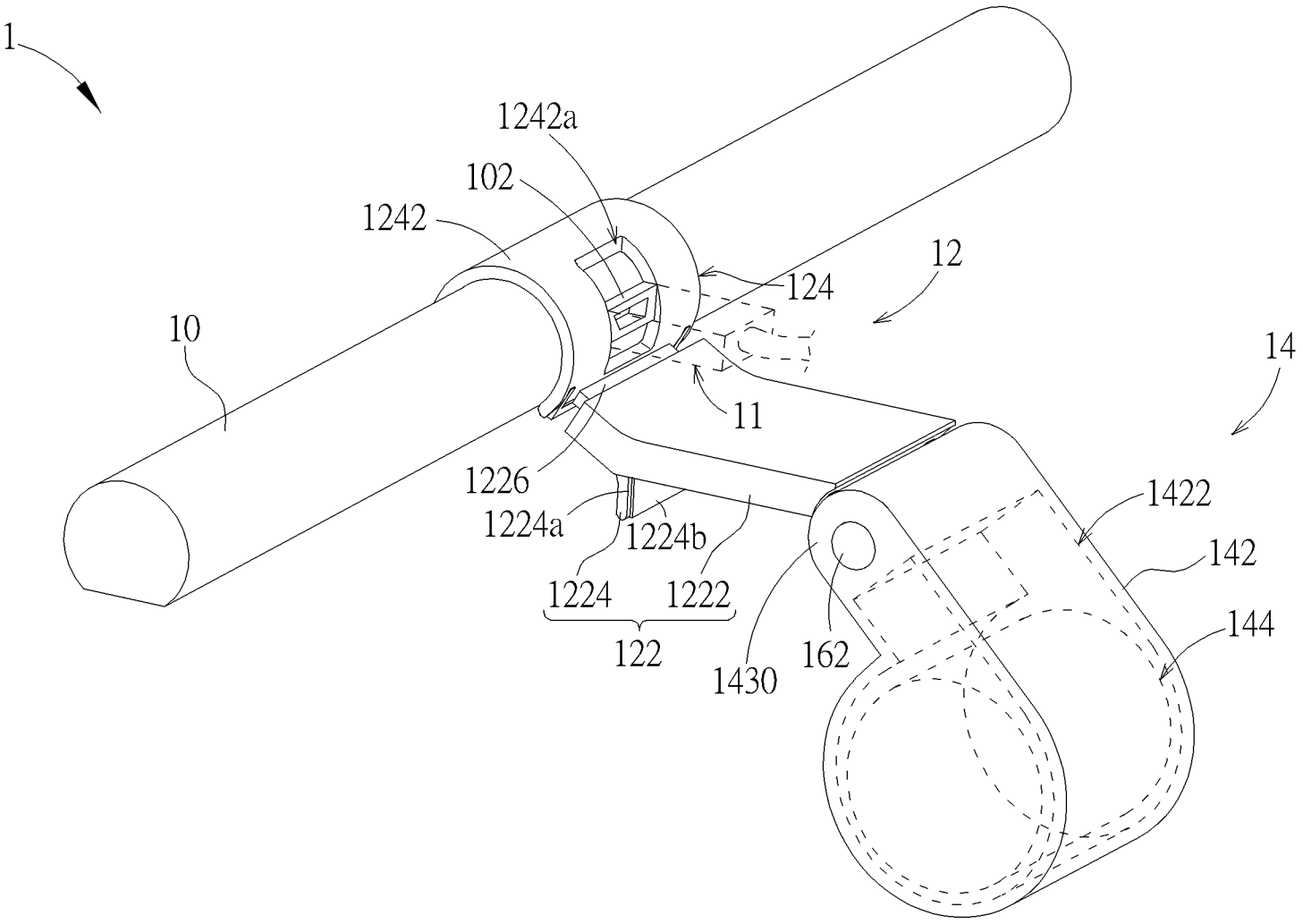
FIG. 1 is a schematic diagram illustrating a clamp lamp of an embodiment according to the invention.
Figure 2:
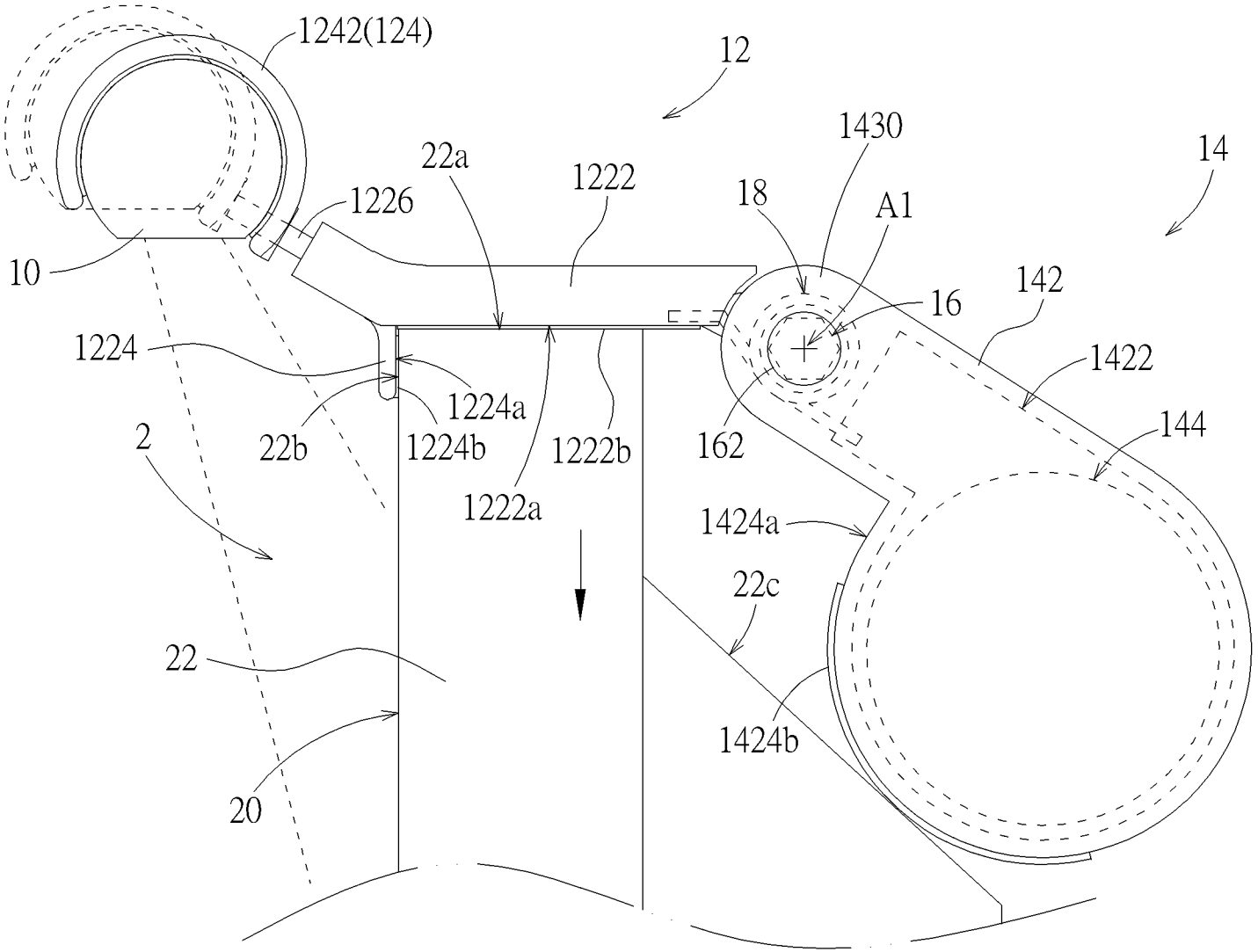
FIG. 2 is a side view of the clamp lamp in FIG. 1 when disposed on a monitor.

Please refer to FIG. 1 and FIG. 2. A clamp lamp 1 of an embodiment according to the invention includes a light source 10, a first clamping part 12, and a second clamping part 14. The first clamping part 12 has a first holding portion 122 and a lamp connecting portion 124 connected to the first holding portion 122. The light source 10 is connected to the lamp connecting portion 124. The second clamping part 14 has a second holding portion 142 and a counterweight 144 (shown in hidden lines the figures) disposed on the second holding portion 142. The first holding portion 122 and the second holding portion 142 are movably connected with each other. Thereby, when the clamp lamp 1 is disposed on a monitor 2 (for example but not limited to a monitor on a table), the light source 10 can provide illumination (indicated by dashed lines in FIG. 2) to a screen of the monitor 2; therein, the light source 10 has a socket 102 and receives external electric power through an electrical connection cable 11 (shown in dashed lines in FIG. 1) inserted into the socket 102 (e.g. from a notebook computer, a desktop computer, or a device or connection interface capable of providing electric power). In the installation of the clamp lamp 1, the first holding portion 122 is placed on an outer casing 22 of the monitor 2. Because the counterweight 144 and the lamp connecting portion 124 are located at two sides of the connection of the first holding portion 122 and the second holding portion 142 relative to a gravity direction (indicated by an arrow in FIG. 2), the counterweight 144 makes the first holding portion 122 and the second holding portion 142 approach each other to clamp the outer casing 22. Therein, in the embodiment, the first holding portion 122 and the second holding portion 142 are pivotally connection. A pivot axis A1 therefor is indicated by a cross mark in FIG. 2. Therefore, in the viewpoint of FIG. 2, the counterweight 144 (or the second clamping part 14) produces a clockwise moment relative to the pivot axis A1; the light source 10 (or the light source 10 together with the first clamping part 12) produces a counterclockwise moment relative to the pivot axis A1. The two moments make the first holding portion 122 and the second holding portion 142 approach each other. Furthermore, the two moments are opposite, which can reduce the torque that the fixing structure of the clamp lamp 1 (including the first holding portion 122 and the second holding portion 142 in the embodiment) sustains. It can be obtained by a static force analysis and will not be described in addition. In other words, when the first clamping part 12 and the second clamping part 14 clamp an object (e.g. an upper side of the outer casing 22), the counterweight 144 and the lamp connecting portion 124 are located at two sides of the object (i.e. the outer casing 22), which is conducive to reduction of the torque that the fixing structure of the clamp lamp 1 sustains and which also makes an extension line of the gravity center of the clamp lamp 1 pass through or close to an upper surface 22*a* of the outer casing 22 such that the clamping force of the first clamping part 12 and the second clamping part 14 to the outer casing 22 can substantially prevent the clamp lamp 1 from moving (including rotating) relative to the outer casing 22 (therein, when the gravity center of the clamp lamp 1 passes through the upper surface 22*a* of the outer casing 22, the clamp lamp 1 will not rotate relative to the outer casing 22). In addition, the weight of the counterweight 144 can depend on the weight of the light source 10 and the position of the clamp lamp 1 in use relative to the outer casing 22. For example, the counterweight 144 and the light source 10 are equal in weight. The light source 10 emits light by using but not limited to light-emitting diodes.

Figure 3:
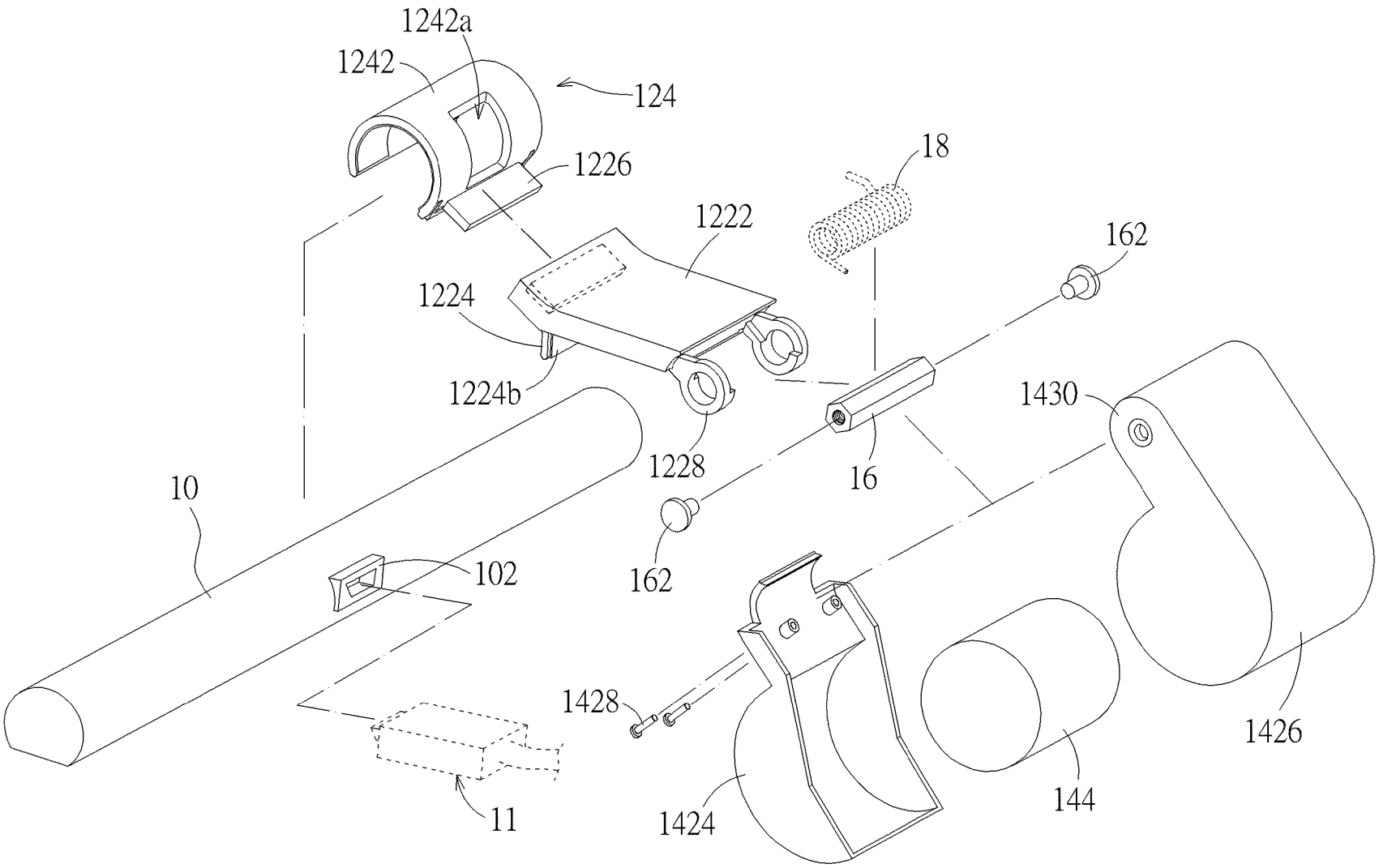
FIG. 3 is an exploded view of the clamp lamp in FIG. 1.

Please also refer to FIG. 3. Furthermore, in the embodiment, the first holding portion 122 has a supporting portion 1222 and an abutting portion 1224 protruding from the supporting portion 1222. The first holding portion 122 is connected with the second holding portion 142 through the supporting portion 1222. When the clamp lamp 1 is disposed on the outer casing 22, the supporting portion 1222 and the abutting portion 1224 contact the upper surface 22*a* and the front surface 22*b* of the outer casing 22 respectively; therein, the abutting portion 1224 can prevent the second clamping part 14 from dragging the first clamping part 12 rightward due to the counterweight 144 in the viewpoint of FIG. 2. In practice, the supporting portion 1222 has a slip-proof pad 1222*b* on a surface 1222*a* thereof that is used to abut against the upper surface 22*a* of the outer casing 22; the abutting portion 1224 have a slip-proof pad 1224*b* on a surface 1224*a* thereof that is used to abut against the front surface 22*b* of the outer casing 22. The slip-proof pads 1222*b* and 1224*b* can increase the friction forces between the outer casing 22 and the supporting portion 1222 and the abutting portion 1224 respectively, which is conducive to a stable disposition of the clamp lamp 1 on the outer casing 22. In practice, the slip-proof pads 1222*b* and 1224*b* can be but not limited to rubber pads.

Figure 4:
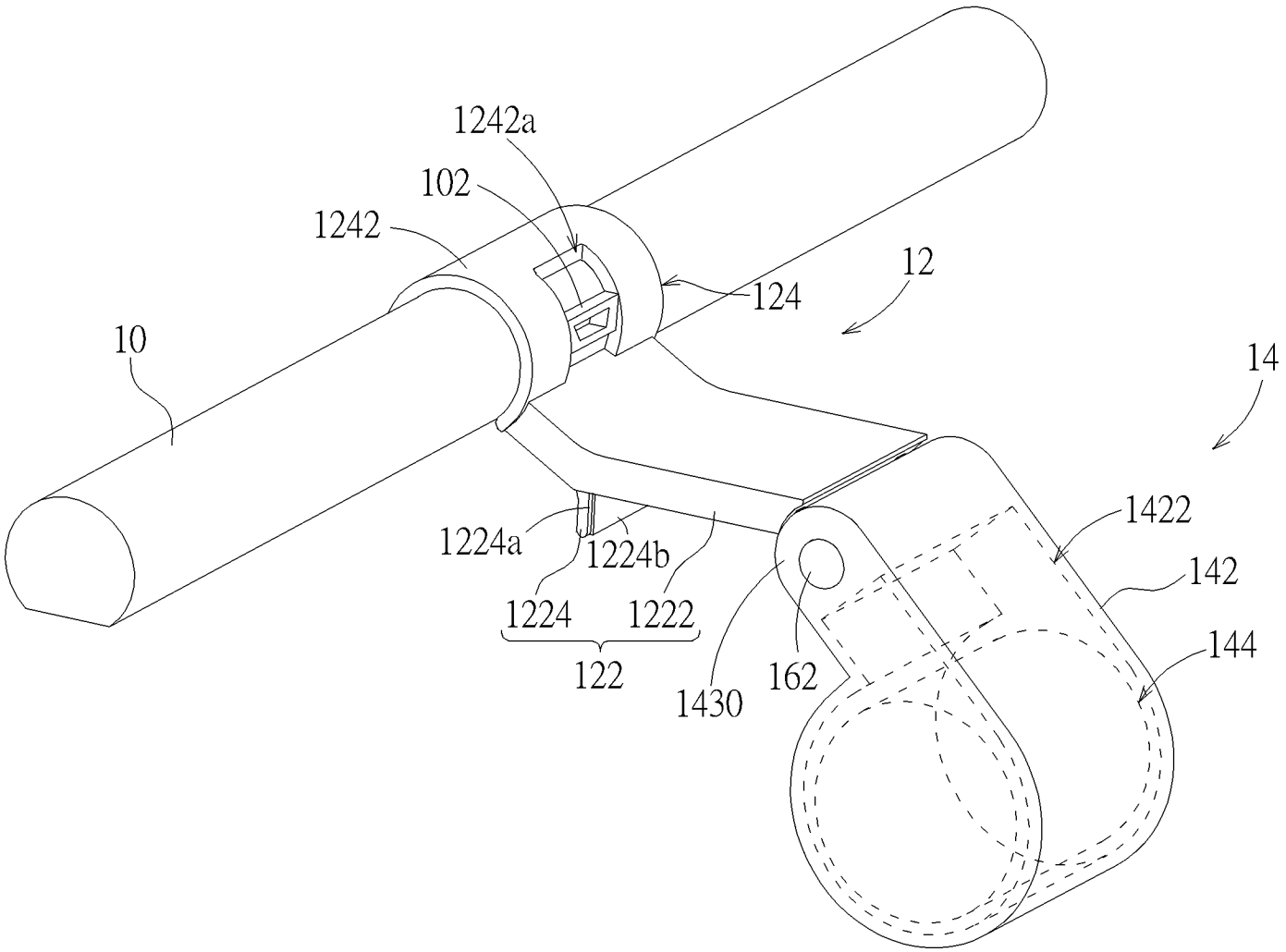
FIG. 4 is a schematic diagram illustrating a clamp lamp of another embodiment.

In the embodiment, the lamp connecting portion 124 includes a C-shaped resilient clip 1242. The light source 10 is clamped by the C-shaped resilient clip 1242. The first holding portion 12 includes a first sliding part 1226 and a second sliding part. The first sliding part 1226 is connected to the C-shaped resilient clip 1242 of the lamp connecting portion 124. The first sliding part 1226 and the second sliding part are restrictedly slidably connected with each other. In the embodiment, the supporting portion 1222 also serves as the second sliding part, so the second sliding part is connected to the second holding portion 142; however, the invention is not limited thereto. In the embodiment, the sliding connection of the first sliding part 1226 with the second sliding part (i.e. the supporting portion 1222) is obtained by inserting the first sliding part 1226 into an insertion slot (shown in hidden lines in FIG. 3) formed on the supporting portion 1222; however, the invention is not limited thereto. In practice, the first sliding part 1226 and the second sliding part (i.e. the supporting portion 1222) can be relatively positioned by friction force. The magnitude of the friction force can be determined such that a user is allowed to move the first sliding part 1226 for adjusting the distance between the light source 10 and the screen 29. When the clamp lamp 1 is in use, the user can move the first sliding part 1226 relative to the second sliding part (i.e. the supporting portion 1222) for adjusting the distance between the light source 10 and the first holding portion 122 or the object (i.e. the outer casing 22), i.e. the distance between the light source 10 and the screen 20, as shown by the lamp connecting portion 124 in dashed lines in FIG. 2. Furthermore, in the embodiment, the light source 10 is rotatably clamped by the C-shaped resilient clip 1242. Therein, the C-shaped resilient clip 1242 has a limitation slot 1242*a*. The socket 102 is slidably disposed in the limitation slot 1242*a*. Thereby, by the coordination of the socket 102 with the limitation slot 1242*a*, the angular range within which the light source 10 can rotate relative to the C-shaped resilient clip 1242 is limited. In practice, it is practicable to attach the light source 10 onto the C-shaped resilient clip 1242 in a fixed relative angle. In addition, in practice, the lamp connecting portion 124 and the first holding portion 122 can be formed in a single piece, e.g. by plastic injection molding, as shown by FIG. 4.

Please back to FIG. 1 to FIG. 3. In the embodiment, the second holding portion 142 has an accommodating room 1422 (shown in dashed lines in FIG. 1 and FIG. 2). The counterweight 144 is accommodated in the accommodating room 1422. Therein, the second holding portion 142 includes a first casing 1424 and a second casing 1426. The first casing 1424 and the second casing 1426 are engaged with each other to form the accommodating room 1422. In the embodiment, the second holding portion 142 further includes a fastening part 1428, which fastens the first casing 1424 and the second casing 1426 together so that the counterweight 144 can be disposed in the accommodating room 1422 firmly. Therein, the fastening part 1428 is achieved by two screws, but the invention is not limited thereto. When the clamp lamp 1 is disposed on the outer casing 22, the second holding portion 142 contacts the outer casing 22. Similarly, in practice, the second holding portion 142 has a slip-proof pad 1424*b* on a surface thereof (i.e. a surface 1424*a* of the first casing 1424) that is used for abutting against the rear surface 22*c* of the outer casing 22, for increasing the friction force between the second holding portion 142 and the outer casing 22, which is conducive to a stable disposition of the clamp lamp 1 on the outer casing 22.

Furthermore, in the embodiment, the first holding portion 122 and the second holding portion 142 are pivotally. Therein, the first holding portion 122 has a first pivotal connection portion 1228 disposed on the supporting portion 1222. The second holding portion 142 has a second pivotal connection portion 1430 disposed on the second casing 1426. The first pivotal connection portion 1228 and the second pivotal connection portion 1430 are pivotally connected through a pivot axle 16 (shown in dashed lines in FIG. 2). The pivot axle 16 passes through the first pivotal connection portion 1228 and the second pivotal connection portion 1430. A fixing part 162 is attached onto each end of the pivot axle 16, such that the first pivotal connection portion 1228 and the second pivotal connection portion 1430 can be constrained between the two fixing parts 162 and stably pivotally connected.

Figure 5:
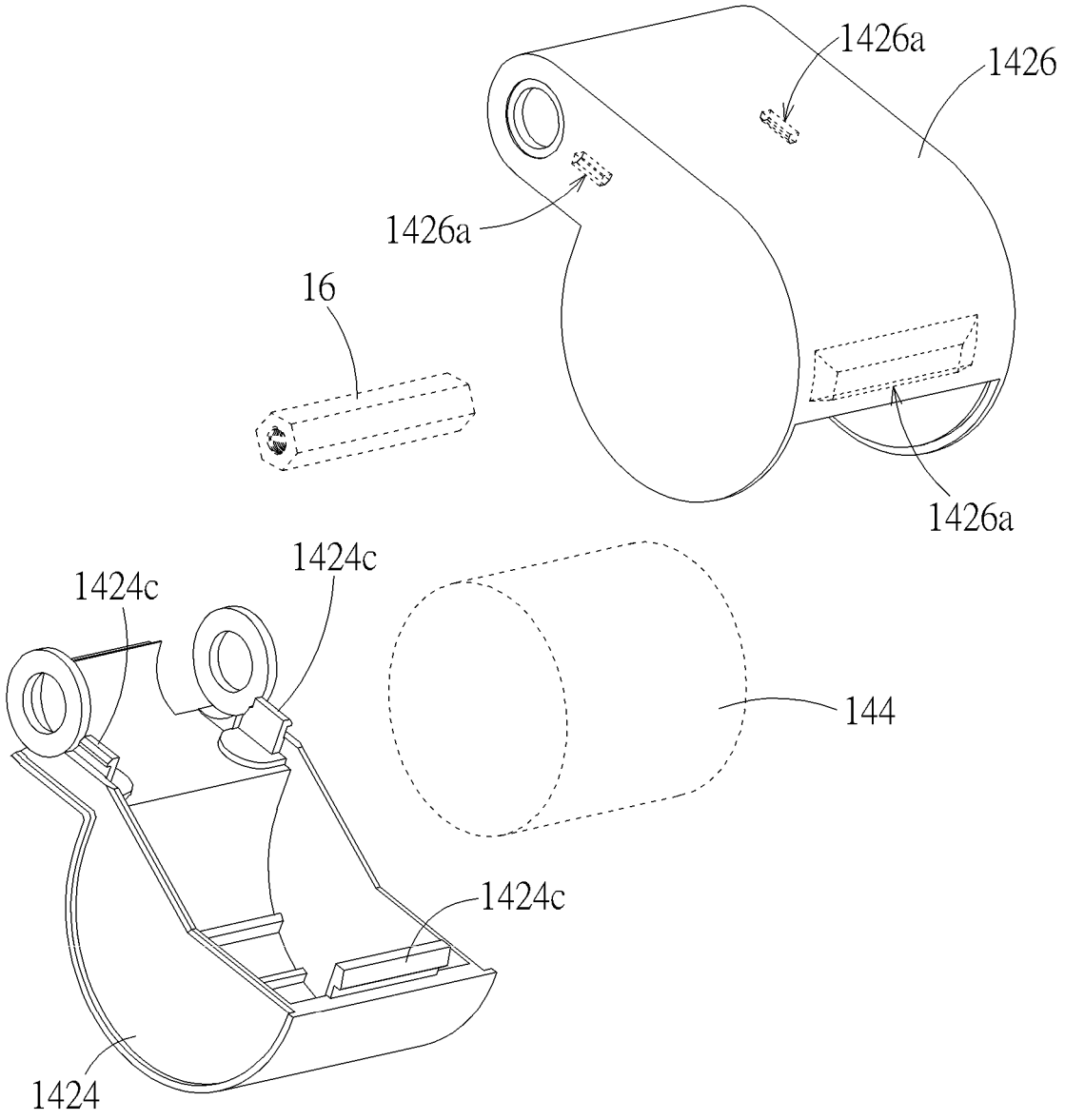
FIG. 5 is an exploded view of a second holding portion of another embodiment.

In addition, in practice, the first casing 1424 and the second casing 1426 can be engaged with each other by other methods. For example, as shown by FIG. 5, the first casing 1424 includes a first engagement part 1424*c* (achieved by three hooks). The second casing 1426 includes a second engagement part 1426*a* (achieved by one lock slot and two protrusive blocks, of which the profiles are shown in hidden lines in FIG. 5). The first casing 1424 and the second casing 1426 are joined by engaging the first engagement part 1424*c* with the second engagement part 1426*a* (i.e. the three hooks hooking the lock slot and the two protrusive blocks respectively). In this case, the fastening part 1428 in FIG. 3 can be skipped; however, in practice, the first casing 1424 and the second casing 1426 can be engaged by the above two joining structures at the same time. Furthermore, as shown in FIG. 5, the first casing 1424 and the second casing 1426 are also pivotally connected through the pivot axle 16 (shown in dashed lines in the figure). In other words, without the engagement of the first engagement part 1424*c* and the second engagement part 1426*a*, the first casing 1424 and the second casing 1426 can relatively pivot about the pivot axle 16. Such structural configuration is convenient for the user to attach or detach the counterweight 144 (shown in dashed lines in the figure). For example, the user can apply force directly to the first casing 1424 and the second casing 1426 so as to separate the first engagement part 1424*c* from the second engagement part 1426*a*. At the moment, the second holding portion 142 is open, and then, the user can attach or detach the counterweight 144. Similarly, the user can make the first casing 1424 and the second casing 1426 relatively rotate and close to each other so as to engaging the first engagement part 1424*c* with the second engagement part 1426*a*.

Please refer back to FIG. 1 to FIG. 3. In the embodiment, when in use, the clamp lamp 1 uses the counterweight 144 to make the first holding portion 122 and the second holding portion 142 approach each other. In practice, the clamp lamp 1 can further include a resilient part 18 (shown in dashed lines in FIG. 2 and FIG. 3) which is disposed where the first holding portion 122 and the second holding portion 142 are pivotally connected and makes the first holding portion 122 and the second holding portion 142 approach each other. In the embodiment, the resilient part 18 is a torsion spring sleeved on the pivot axle 16. Two ends of the torsion spring abut against the first holding portion 122 and the second holding portion 142 respectively; however, the invention is not limited thereto. For example, it is practicable to use a tension spring, of which two ends are fixed to the first holding portion 122 and the second holding portion 142 respectively, so as to make the first holding portion 122 and the second holding portion 142 approach each other.

Figure 6:
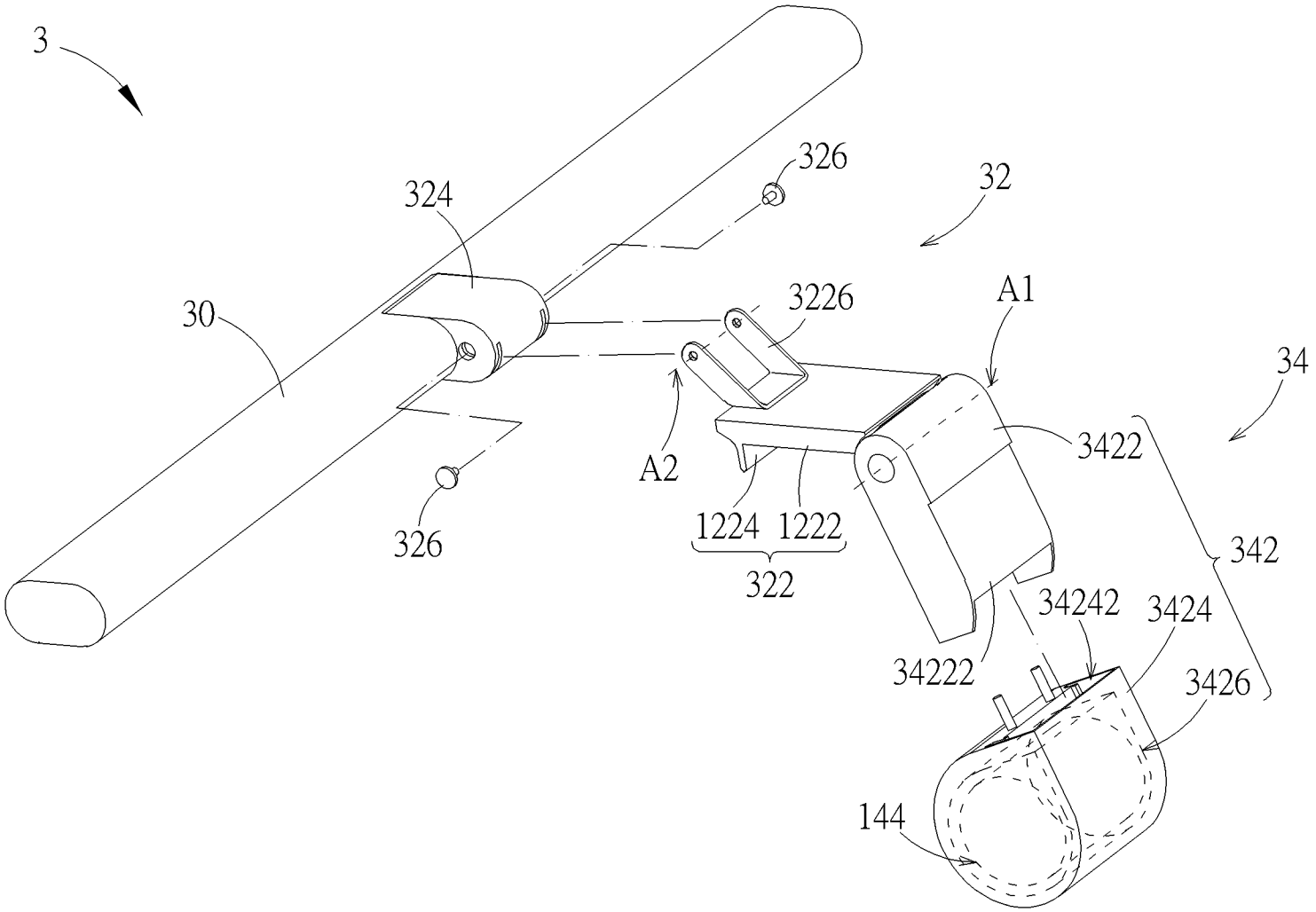
FIG. 6 is a partially exploded view of a clamp lamp of another embodiment.

In addition, in the embodiment, the disposition angle of the light source 10 can be adjusted through the C-shaped resilient clip 1242 having the limitation slot 1242*a*, but the invention is not limited thereto. As shown by FIG. 6, a clamp lamp 3 of another embodiment is substantially structurally similar to the clamp lamp 1 and uses the reference numbers of the clamp lamp 1 in principle. For other descriptions about the clamp lamp 3, please refer to the relevant descriptions of the clamp lamp 1, which will not be described in addition. A difference between the clamp lamp 3 and the clamp lamp 1 is that a first holding portion 322 of a first clamping part 32 of the clamp lamp 3 includes a pivotal connection mount 3226. A connecting portion 324 of the clamp lamp 3 is pivotally connected with the pivotal connection mount 3226 (e.g. by but not limited to two screws 326). A pivot axis A2 therefor is shown in dashed lines in FIG. 6. Thereby, a light source 30 of the clamp lamp 3 which is connected to the connecting portion 324 can rotate relative to the pivotal connection mount 3226 through the lamp connecting portion 324 for angular adjustment. In the embodiment, the pivot axis A2 and the pivot axis A1 (both shown in dashed lines in FIG. 6) are parallel.

Furthermore, in the clamp lamp 1, the distance between the counterweight 144 and the pivot axis A1 (or the pivot axle 16) is fixed; however, the invention is not limited thereto. As shown by FIG. 6, a second holding portion 342 of a second clamping part 34 of the clamp lamp 3 includes a third sliding part 3422 and a fourth sliding part 3424. The third sliding part 3422 and the fourth sliding part 3424 are restrictedly slidably connected with each other. The counterweight 144 is disposed on the fourth sliding part 3424. Therein, the third sliding part 3422 and the supporting portion 1222 of the first holding portion 322 are pivotally connected. The third sliding part 3422 has an insertion portion 34222. The fourth sliding part 3424 has an insertion slot 34242 correspondingly. The insertion portion 34222 is movably inserted into the insertion slot 34242. In practice, the fixing and adjusting of the insertion portion 34222 and the insertion slot 34242 can be performed by friction force, the coordination of a nut (rotatably disposed on the insertion portion 34222) and a leadscrew (fixed on the fourth sliding part 3424 and meshing with the nut), and so on. The second holding portion 342 has an accommodating room 3426 in the fourth sliding part 3424 (or formed by the fourth sliding part 3424, shown in hidden lines in FIG. 6). The counterweight 144 (shown in hidden lines in FIG. 6) is accommodated in the accommodating room 3426. Thereby, by adjusting the relative position of the third sliding part 3422 to the fourth sliding part 3424, the distance from the counterweight 144 to the pivot axis A1 (or the pivot axle 16), the object (i.e. the outer casing 22), or the light source 30 is adjusted.

Figure 7:
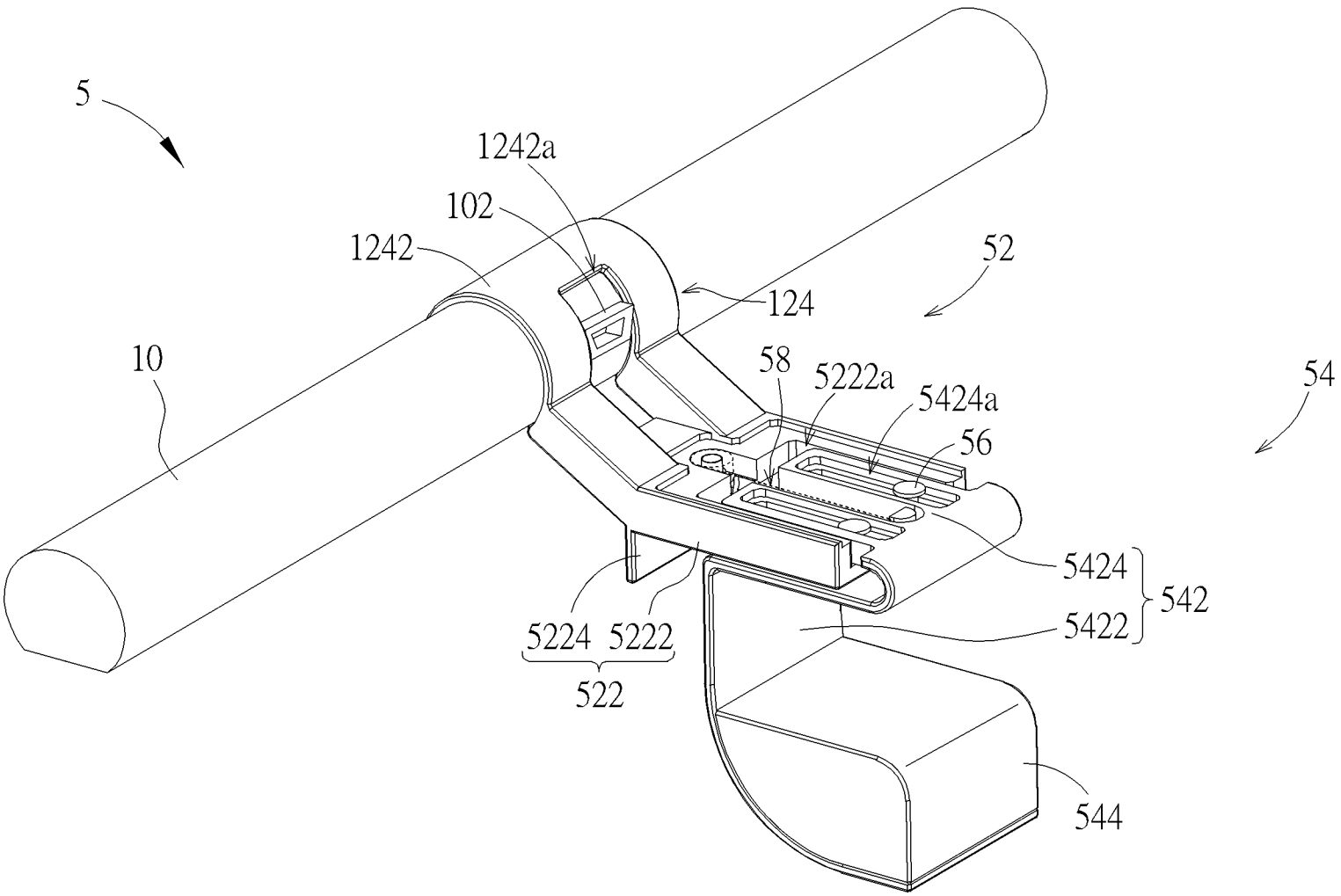
FIG. 7 is a schematic diagram illustrating a clamp lamp of another embodiment.
Figure 8:
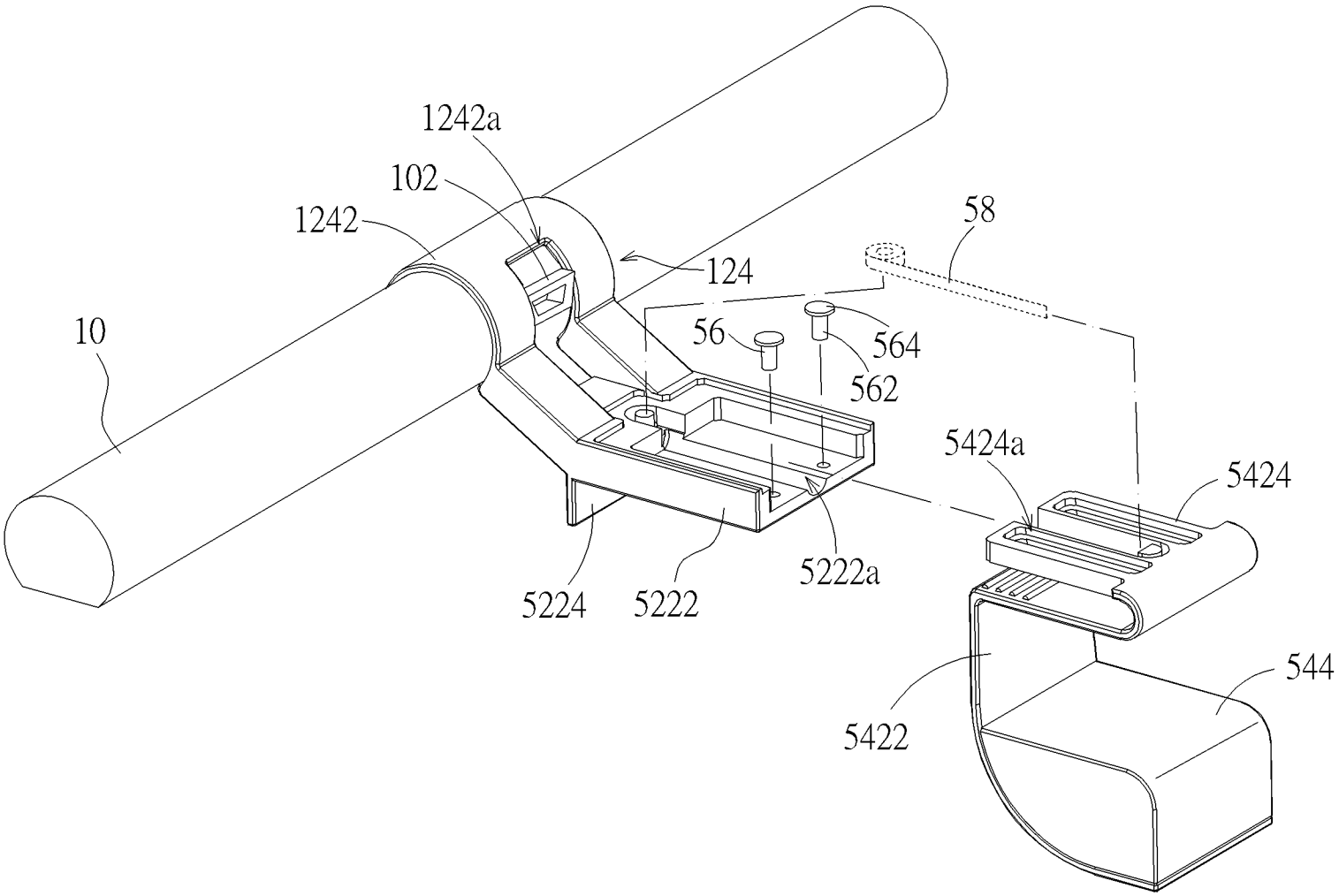
FIG. 8 is a partially exploded view of the clamp lamp in FIG. 7.

In the above embodiments, the movable connection of the first holding portions 122 and 322 and the second holding portions 142 and 342 is achieved by pivotally connection; however, the invention is not limited thereto. As shown by FIG. 7 and FIG. 8, a clamp lamp 5 of another embodiment is substantially structurally similar to the clamp lamp 1 and uses the reference numbers of the clamp lamp 1 in principle. For other descriptions about the clamp lamp 5, please refer to the relevant descriptions of the clamp lamp 1, which will not be described in addition. In the clamp lamp 5, a first clamping part 52 and a second clamping part 54 thereof are movably connected with each other by slidable connection. A first holding portion 522 of the first clamping part 52 and a second holding portion 542 of the second clamping part 54 are restrictedly slidably connected with each other. The first holding portion 522 has a supporting portion 5222 and an abutting portion 5224 protruding from the supporting portion 5222. The first holding portion 522 is restrictedly slidably connected with the second holding portion 542 through the supporting portion 5222. Therein, the supporting portion 5222 has a sliding slot 5222*a*. The second holding portion 542 includes a main body 5422 and a sliding portion 5424 connected to the main body 5422. The sliding portion 5424 slides in the sliding slot 5222*a*. A counterweight 544 is fixed on the main body 5422 (e.g. by but not limited to screwing, adhering and so on). In the embodiment, the clamp lamp 5 includes two guiding posts 56. The guiding post 56 has a post body 562 and a constraint portion 564 at an end of the post body 562. The post body 562 passes through a slot hole 5424*a* of the sliding portion 5424 and is fixed in the sliding slot 5222*a* through the other end thereof. The constraint portion 564 constrains the sliding portion 5424 to slide in the sliding slot 5222*a*. Thereby, by adjusting the relative position of the sliding portion 5424 and the sliding slot 5222*a*, the distance between the main body 5422 and the abutting portion 5224 can be adjusted for adaptation to the outer casing 22 with different thickness. Furthermore, a change of the relative position of the sliding portion 5424 and the sliding slot 5222*a* will change the distance between the counterweight 544 and the light source 10.

In addition, in the embodiment, the clamp lamp 5 can further include a resilient part 58 (shown in dashed lines in FIG. 7 and FIG. 8) which is connected to the supporting portion 5222 and the second holding portion 542 so as to make the abutting portion 5224 and the second holding portion 542 approach each other. In practice, the resilient part 58 can be a constant-force spring (as shown by FIG. 7 and FIG. 8) or a tension spring disposed in the sliding slot 5222*a*. One end thereof is connected to the supporting portion 5222; the other end thereof is connected to the sliding portion 5424.

Those skilled in the art will readily observe that numerous modifications and alterations of the device and method may be made while retaining the teachings of the invention. Accordingly, the above disclosure should be construed as limited only by the metes and bounds of the appended claims.

What is claimed is:

1. A clamp lamp, comprising:

a light source;

a first clamping part, the first clamping part having a first holding portion and a lamp connecting portion connected to the first holding portion, the light source being directly connected to the lamp connecting portion; and a second clamping part, the second clamping part having a second holding portion and a counterweight disposed on the second holding portion, the first holding portion and the second holding portion being movably connected with each other.

2. The clamp lamp of claim 1, wherein the first holding portion and the second holding portion are pivotally connected with each other.

3. The clamp lamp of claim 2, further comprising a resilient part, wherein the resilient part is disposed where the first holding portion and the second holding portion are pivotally connected, for making the first holding portion and the second holding portion approach each other.

4. The clamp lamp of claim 1, wherein the first holding portion and the second holding portion are restrictedly slidably connected with each other.

5. The clamp lamp of claim 4, wherein the first holding portion has a supporting portion and an abutting portion protruding from the supporting portion, and the first holding portion is restrictedly slidably connected with the second holding portion through the supporting portion.

6. The clamp lamp of claim 5, further comprising a resilient part, connected to the supporting portion and the second holding portion for making the abutting portion and the second holding portion approach each other.

7. The clamp lamp of claim 1, wherein the first holding portion has a supporting portion and an abutting portion protruding from the supporting portion, and the first holding portion is connected with the second holding portion through the supporting portion.

8. The clamp lamp of claim 7, wherein the supporting portion, the abutting portion, and the second holding portion have a slip-proof pad respectively.

9. The clamp lamp of claim 1, wherein the second holding portion has an accommodating room, and the counterweight is disposed in the accommodating room.

10. The clamp lamp of claim 9, wherein the second holding portion comprises a first casing and a second casing, and the first casing and the second casing are engaged to form the accommodating room.

11. The clamp lamp of claim 10, wherein the second holding portion comprises a fastening part fastening the first casing and the second casing together.

12. The clamp lamp of claim 10, wherein the first casing is pivotally connected to the second casing and comprises a first engagement part, the second casing comprises a second engagement part, and the first casing and the second casing are engaged with each other through the first engagement part and the second engagement part.

13. The clamp lamp of claim 1, wherein the lamp connecting portion comprises a C-shaped resilient clip, and the light source is clamped by the C-shaped resilient clip.

14. The clamp lamp of claim 1, wherein the lamp connecting portion is pivotally connected to the first holding portion.

15. The clamp lamp of claim 1, wherein when the first clamping part and the second clamping part clamp an object, the counterweight and the lamp connecting portion are located at two sides of the object.

16. The clamp lamp of claim 1, wherein the first holding portion comprises a first sliding part and a second sliding part, the first sliding part and the second sliding part are restrictedly slidably connected with each other, the first sliding part is connected to the lamp connecting portion, and the second sliding part is connected to the second holding portion.

17. The clamp lamp of claim 1, wherein the second holding portion comprises a third sliding part and a fourth sliding part, the third sliding part and the fourth sliding part are restrictedly slidably connected with each other, the third sliding part is connected to the first holding portion, and the counterweight is disposed on the fourth sliding part.

18. A displaying device, comprising:

an outer casing; and a clamp lamp, comprising:

a light source;

a first clamping part, the first clamping part having a first holding portion and a lamp connecting portion connected to the first holding portion, the light source being directly connected to the lamp connecting portion; and a second clamping part, the second clamping part having a second holding portion and a counterweight disposed on the second holding portion, the first holding portion and the second holding portion being movably connected with each other, the clamp lamp being disposed on the outer casing through the first clamping part and the second clamping part.

19. The displaying device of claim 18, wherein the first holding portion and the second holding portion are pivotally connected with each other.

20. The displaying device of claim 18, wherein the first holding portion and the second holding portion are restrictedly slidably connected with each other.

* * * * *